US005687444A

United States Patent [19]

Hakker

[11] Patent Number: 5,687,444

[45] Date of Patent: Nov. 18, 1997

[54] DEVICE FOR CLEANING PAINT BRUSHES OR THE LIKE

[76] Inventor: Johannes Cornelis Hakker, Noorderweg 81c, NL-3761 EV Soest, Netherlands

[21] Appl. No.: 581,616

[22] PCT Filed: Jul. 22, 1994

[86] PCT No.: PCT/NL94/00172

§ 371 Date: May 17, 1996

§ 102(e) Date: May 17, 1996

[87] PCT Pub. No.: WO95/02976

PCT Pub. Date: Feb. 2, 1995

[30] Foreign Application Priority Data

Jul. 22, 1993 [NL] Netherlands ..... 9301288

[51] Int. Cl.[6] ..... A46B 17/06; B44D 3/12; B44D 3/00

[52] U.S. Cl. ..... 15/104.92; 15/142; 15/257.01; 206/15.3; 206/362; 220/4.24; 220/23.86; 220/571.1; 220/608

[58] Field of Search ..... 15/1, 104.001, 15/104.92, 142, 257.01, 257.05; 206/15.3, 362; 220/4.24, 23.86, 571.1, 608

[56] References Cited

U.S. PATENT DOCUMENTS

| | | | |
|---|---|---|---|
| 883,752 | 4/1908 | Spicer | 15/142 |
| 2,546,041 | 3/1951 | Newton et al. | 15/104.92 |
| 2,963,727 | 12/1960 | Roberts | 15/104.92 |
| 3,605,160 | 9/1971 | Maurer | 15/142 X |
| 3,671,992 | 6/1972 | Linger | 15/104.92 |
| 4,387,477 | 6/1983 | Eisenberg | 15/104.92 |
| 4,494,267 | 1/1985 | Fredley | 15/104.92 |
| 4,771,501 | 9/1988 | Leiter | 15/142 X |
| 5,115,532 | 5/1992 | Moore | 15/104.92 |

FOREIGN PATENT DOCUMENTS

| | | | |
|---|---|---|---|
| 3725093 | 11/1988 | Germany | 15/104.92 |
| 94-10875 | 5/1994 | WIPO . | |

*Primary Examiner*—Mark Spisich

*Attorney, Agent, or Firm*—Westman, Champlin & Kelly, P.A.; S. Koehler

[57] ABSTRACT

A device for cleaning paint brushes or the like comprises a container (1) for a cleaning fluid and a plurality of wiping elements (2) projecting upwardly substantially from the bottom of the container. Each wiping element of at least a part of the wiping elements has one or more scraping edges along at least a part of its length, said scraping edges being adapted to cooperate with the paint brush to be cleaned. This is for example obtained in that each wiping element has a polygonal, preferably rectangular cross section at its end adjacent the bottom and tapers from the bottom. Thereby these wiping elements have sharp edges operating as scraping edges when the paint brush to be cleaned is moved along the wiping elements, so that an excellent cleaning action is obtained. The device can be part of an assembly which further comprises a refuse container and a cover for closing the refuse container. This refuse container with corresponding cover can be used for removing the used cleaning fluid with paint rests and can be offered closed as chemical waist to the cleaning service.

10 Claims, 3 Drawing Sheets

DEVICE FOR CLEANING PAINT BRUSHES OR THE LIKE

BACKGROUND OF THE INVENTION

The invention relates to a device for cleaning paint brushes or the like.

Such a device is known from German patent 37 25 093. In this known device the wiping elements consists of thin needles provided at a rather large mutual distance. Although these needles penetrate between the bristles of the paint brush, the cleaning action of the needles leaves much to be desired.

U.S. Pat. No. 4,387,477 discloses a paint roller cleaning system having a container with a plurality of wiping elements made as helical coil members formed of wire with a diameter of 3 mm. The helical coil members are mounted lying in the container.

SUMMARY OF THE INVENTION

The invention-aims to provide a device of the above-mentioned type, wherein the cleaning action of the wiping elements is improved.

To this end the apparatus according to the invention is characterized by the characterizing features of claim 1.

Thereby it is obtained that at least a part of the wiping elements is provided with scraping edges which, so to say, scrape the paint residue and the like off of the bristles of the paint brush when the paint brush to be cleaned is moved along the wiping elements. In this manner an excellent cleaning action is obtained. This shape of the wiping elements provides sharp edges acting as scraping edges and can be manufactured relatively simply. Preferably each wiping element has a polygonal, preferably rectangular cross section at its end adjacent the bottom and tapers from the bottom. The device of the invention allows efficient cleaning of the paint brush with a minimum amount of cleaning fluid.

In order to obtain an optimal cleaning action of the wiping elements it is advantageous according to the invention that the wiping elements are arranged in such a pattern that in two mutual perpendicular directions successive wiping elements are aligned alternatingly with their long and short side, respectively, in the respective direction.

The application possibilities of the device can be increased if the device further comprises clamping means for suspending paint brushes and a cover for closing the container.

In practice the use of the known device has a further disadvantage in this respect that the user has no suitable means available for removing used cleaning fluid and paint residue remaining in the container.

The invention aims to provide a solution for this problem too by providing an assembly for cleaning paint brushes or the like, said assembly comprising the described device of the invention together with a refuse container and a cover for closing the refuse container, wherein the cover and/or refuse container comprises at the inner side an upright edge for holding the container.

In this manner an assembly is obtained, wherein the device is suitable for multiple use whereas the refuse container and the corresponding cover can be made for single use so that the refuse container closed by the cover and filled with the used cleaning fluid and paint residue can be offered as chemical waste.

The invention will be further explained hereinafter by reference to the drawings in which some embodiments of the device and the assembly according to the invention are shown.

DESCRIPTION OF THE PREFERRED EMBODIMENTS

Figure 2:
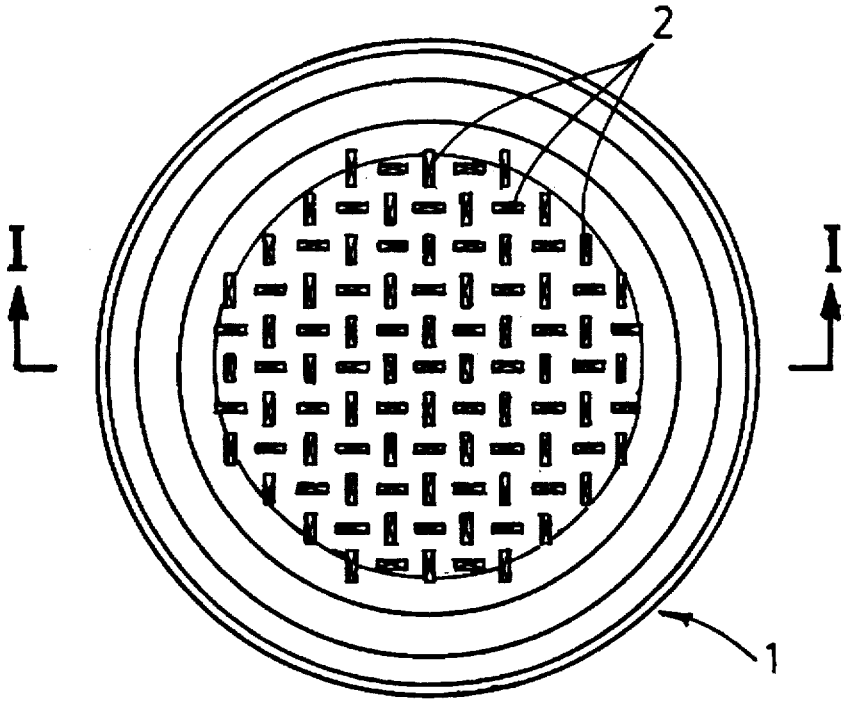
FIG. 2 is a top view of the apparatus of FIG. 1.
Figure 3:
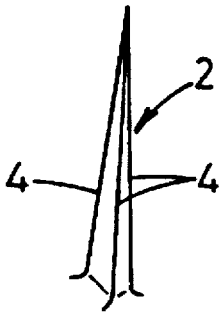
FIG. 3 is a perspective view of a wiping element of the device of FIG. 1.
Figure 1:
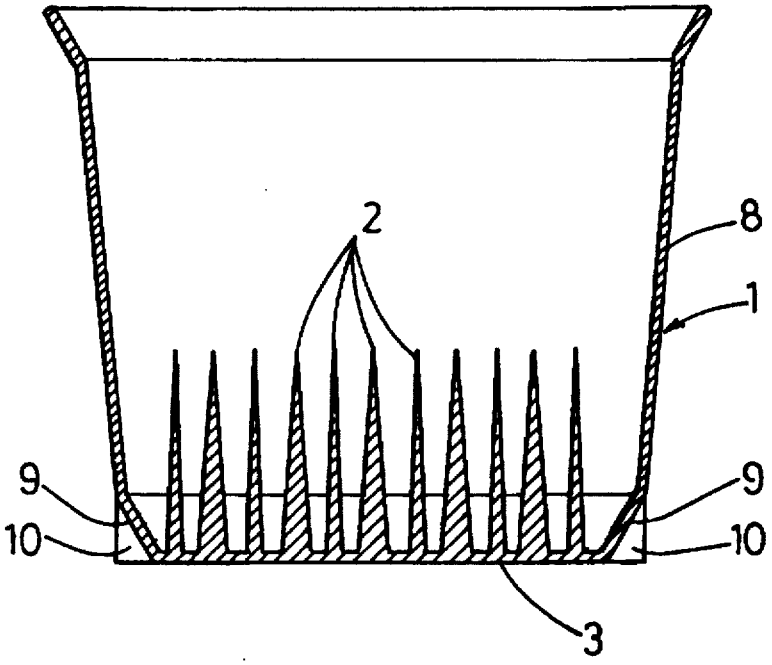
FIG. 1 is a cross-section of a first embodiment of the device according to the invention.

FIGS. 1 and 2 show a device for cleaning paint brushes or a like, comprising a container 1 with a plurality of wiping elements 2. The container 1 and the wiping elements 2 are preferably made as a unit by injection molding. As shown in the top view of FIG. 2, each wiping element has a rectangular cross-section at its end joining the bottom 3 of the container and the wiping elements 2 taper in the manner as shown in FIG. 3. The free end of the wiping elements 2 may have a sharp point or may be truncated. Each wiping element 2 has four sharp edges 4 operating as scraping edges when the device is used for cleaning a paint brush not shown. The wiping elements 2 may also have a different cross-sectional shape, such as triangular, square of pentagonal or another suitable shape with scraping edges. Further it is also possible to use scraping elements with mutually different shapes.

For using the device described an amount of cleaning fluid is poured into the container 1, where after the paint brush to be cleaned is moved back and forth and rotated along the bottom 3 of the container 1 in such a manner that the wiping elements 2 project between the bristles of the paint brush and the edges 4 of the wiping elements 2 scrape along these bristles. Thereby efficient cleaning of the paint brush is obtained wherein a minimum amount of cleaning fluid can be used.

In the embodiment shown in FIGS. 1 and 2, the wiping elements 2 are arranged in such a pattern that in two mutual perpendicular directions successive wiping elements 2 are alternatingly aligned with their long or short side, respectively, with the respective direction. Thereby it is obtained that the bristles of the paint brush to be cleaned wipe along the edges 4 of the wiping elements 2 acting as scraping edges, with certainty.

It is further possible to arrange the wiping elements 2 in such a pattern that a straight line always intersects one or more wiping elements 2 whereby the cleaning action can be further improved. To this end the wiping elements 2 can for example be staggered alternatingly with respect to said perpendicular directions.

Figure 4:
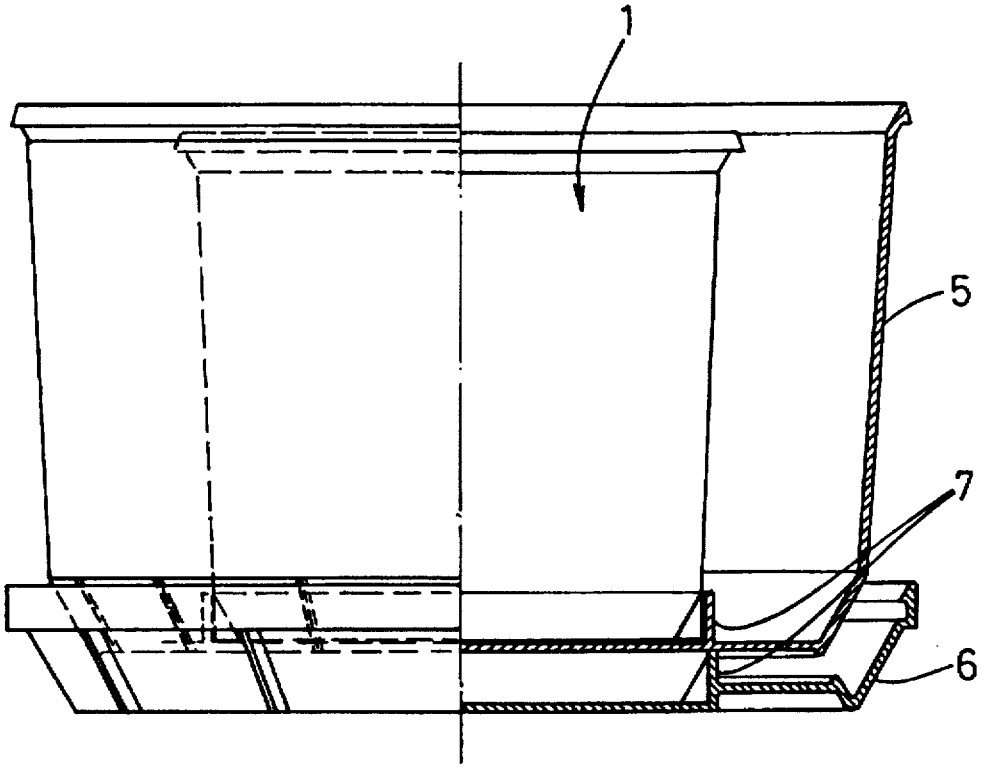
FIG. 4 shows an embodiment of an assembly according to the invention, partially as a side view and partially in cross-section.

In order to improve the use of the device described in practice, the device is preferably supplied as part of an assembly comprising in addition to the device described a refuse container 5 and a cover 6 shown in FIG. 4. If desired the assembly may comprise more than one refuse container 5 and cover 6. It is also possible to supply the refuse container 5 with cover 6 as separate part of the assembly.

Figure 5:
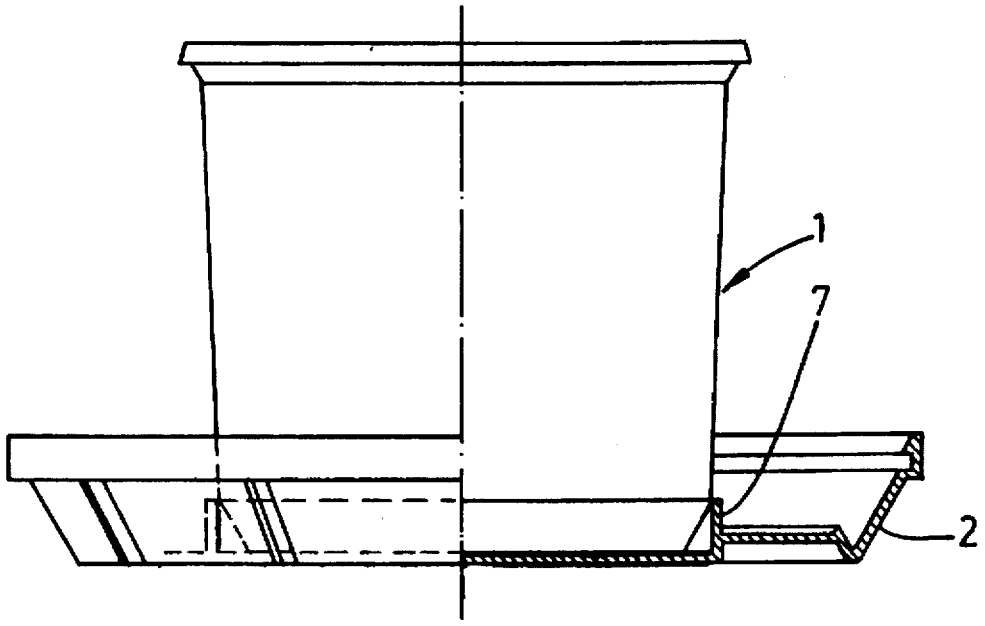
FIG. 5 shows partially as a side view and partially in cross-section the device of FIG. 1 placed in the cover.

In the embodiment shown in FIG. 4 refuse container 5 and cover 6 each are provided with an upright edge 7 at the inner side, which edge is intended for holding the container 1. In the situation shown in FIG. 4 the assembly may be put on the market or may be stored by the user. In FIG. 5 the container 1 is located in the upright edge 7 of the cover 6, in which position the container 1 is preferably used for cleaning a paint brush. Thereby any spilled fluid can be received in the cover 6.

As shown in FIG. 1 the outer wall 8 of the container near the bottom 3 extends obliquely inwardly and at the location of this oblique wall part 9 a plurality of support ribs 10 is provided, said ribs being uniformally distributed along the circumference. The upright edge of the cover 6 and if necessary the edge of the refuse container 5 too is provided with slots not shown at the inner side, said slots cooperating with the support ribs 10 for holding the container 1 in the upright edge 7.

The refuse container 5 of the assembly described has a substantially larger content than the same of the container 1 so that, after cleaning one or more paint brushes, the fluid poured into the container 1 together with the paint residue received in the same can be emptied a plurality of times into the refuse container 5, whereafter the refuse container 5 is hermetically sealed with the cover 6. Thereafter the refuse container 5 can be offered as chemical waste to the cleansing service. In this manner the container 1 can be made as a container suitable for repeated use, while the refuse container 5 and cover 6 only need to be suitable for single use.

Figure 6:
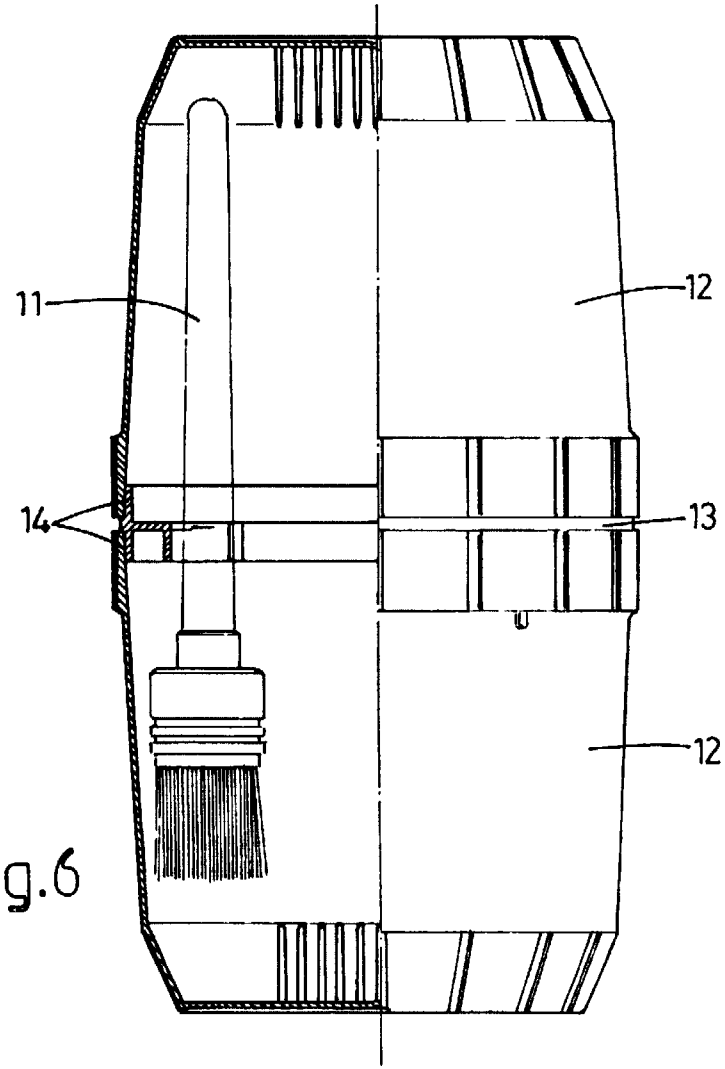
FIG. 6 shows a second embodiment of the device according to the invention partially in cross-section and partially as a side view.
Figure 7:
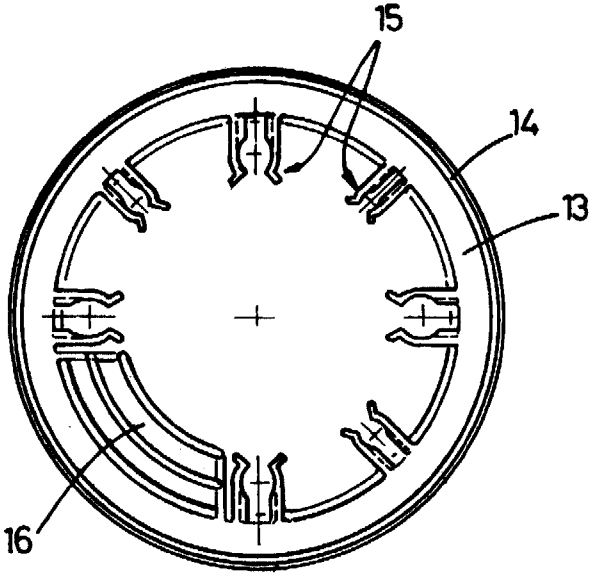
FIG. 7 is a top view of the ring of the device of FIG. 6.

In FIGS. 6 and 7 an embodiment of the device for cleaning paint brushes or the like is shown, which is also suitable for storing paint brushes. A paint brush 11 is schematically shown in FIG. 6. In this case the device includes two mutual identical containers 12, each having wiping elements 2. Further the device comprises a ring 13 with an upright edge 14 at both sides, which edge can be fittingly received in the container 12. The ring 13 is inserted with one upright edge 14 into a container 12, wherein a second container 12 can be placed upon the other upright edge 14, whereby a closed storage device is obtained.

The ring 13 has a plurality of clamps 15 for suspending paint brushes and a wiping surface 16 which can be helpful in cleaning the paint brushes.

Although the embodiments described are used for cleaning paint brushes, it is of course also possible to clean other types of brushes or bristles by means of the device according to the invention, such as glue brushes, tar brushes, etc.

The invention is not restricted to the above described embodiments which can be varied in a number of ways within a scope of the invention.

I claim:

1. A device for cleaning a brush (11), comprising a container (1, 12) for a cleaning fluid and a plurality of elongated wiping elements (2) projecting upwardly in their longitudinal direction substantially from a bottom (3) of the container, wherein each wiping element (2) has at least one sharp scraping edge (4) along at least a part of its upward length, said scraping edge being adapted to cooperate with the bristles of the brush (11) to be cleaned, wherein each wiping element (2) has a polygonal cross section with a long and short side from an end adjacent the bottom (3) toward a free end thereof and tapers from the bottom, said wiping elements (2) being arranged in such a pattern that in two mutual perpendicular directions successive wiping elements (2) are aligned alternatingly with their long and short side, respectively, in the respective direction.

2. The device according to claim 1, wherein the wiping elements (2) are arranged in such a pattern that a straight line always intersects with at least one of the wiping elements.

3. The device according to claims 1 or 2, wherein the container (1) and wiping elements are made as a unit.

4. The device according to claims 1 or 2, and further comprising clamping means (15) for suspending the brush (11) within the container (12) and a cover (12) for closing the container (12).

5. The device according to claim 4, wherein the clamping means (15) is part of a loose separate ring (13) with an upright edge (14) at opposite sides thereof which can be fittingly received in the container (12) and the cover (12), respectively.

6. The device according to claim 5, wherein the container (12) and the cover (12) are identical.

7. The device according to claims 1 or 2 and further comprising, a refuse container (5) and a cover (6) for closing the refuse container, wherein the cover and the refuse container comprise at an inner side thereof an upright edge (7) for holding the container (1).

8. The device according to claim 7, wherein an outer wall (8) of the container (1) near the bottom (3) includes an oblique wall portion (9) that extends inwardly and wherein the oblique wall portion (9) includes a plurality of support ribs (10) uniformly distributed along the circumference, wherein the upright edge (7) of the cover (6) and the refuse container (5) are provided with slots adapted to cooperate with the support ribs of the container for holding the container.

9. The device according to claim 7 wherein a volume of the refuse container (5) is substantially greater than a volume of the container (1).

10. The device according to claims 1 or 2 wherein the polygonal cross section is rectangular.

* * * * *